US008702435B2

(12) United States Patent
Tajima

(10) Patent No.: US 8,702,435 B2
(45) Date of Patent: Apr. 22, 2014

(54) PLUG, PLUG RECEPTACLE AND ELECTRIC POWER SUPPLYING SYSTEM

(75) Inventor: Shigeru Tajima, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 13/128,822

(22) PCT Filed: Nov. 12, 2009

(86) PCT No.: PCT/JP2009/069259

§ 371 (c)(1),
(2), (4) Date: May 11, 2011

(87) PCT Pub. No.: WO2010/070999

PCT Pub. Date: Jun. 24, 2010

(65) Prior Publication Data

US 2011/0237098 A1 Sep. 29, 2011

(30) Foreign Application Priority Data

Dec. 18, 2008 (JP) ..... 2008-322547

(51) Int. Cl.
*H01R 13/44* (2006.01)

(52) U.S. Cl.
USPC ..... 439/140

(58) Field of Classification Search
USPC ..... 439/135–144, 680
See application file for complete search history.

(56) References Cited

U.S. PATENT DOCUMENTS 2,396,901 A * 3/1946 Tiffany ..... 439/140
2,444,843 A * 7/1948 Modrey ..... 439/140
3,167,373 A * 1/1965 Kostich ..... 439/140
3,210,717 A * 10/1965 Brown ..... 439/140
3,271,725 A * 9/1966 Bloch ..... 439/141
3,513,435 A * 5/1970 Degaetano ..... 439/140
3,575,684 A * 4/1971 McIntyre ..... 439/140
3,747,047 A * 7/1973 Carter et al. ..... 439/141
3,754,205 A * 8/1973 Lenkey ..... 439/141
3,818,466 A * 6/1974 Honda ..... 340/517
3,839,697 A * 10/1974 Obert ..... 439/141

(Continued)

FOREIGN PATENT DOCUMENTS

DE 2949098 A1 6/1981
DE 92111368 11/1992

(Continued)

OTHER PUBLICATIONS

English-language translation of International Search Report from the Japanese Patent Office for International Application No. PCT/JP2009/069259, mailing date Dec. 22, 2009.

(Continued)

*Primary Examiner* — Ross Gushi

(74) *Attorney, Agent, or Firm* — Finnegan, Henderson, Farabow, Garrett & Dunner, LLP

(57) ABSTRACT

A plug is provided that includes: at least two electrodes; a housing that supports the electrodes; an electrode cover which covers the electrodes when not connected with a plug receptacle, and which is accommodated in the housing and exposes the electrodes when connected with the plug receptacle; and a lock mechanism which inhibits the electrode cover from being accommodated in the housing when not connected with the plug receptacle, and which allows the electrode cover to be accommodated in the housing when connected with the plug receptacle.

6 Claims, 8 Drawing Sheets

(56) References Cited

U.S. PATENT DOCUMENTS

| | | | | | |
|---|---|---|---|---|---|
| 4,109,989 | A * | 8/1978 | Snyder et al. | 439/140 |
| 4,203,640 | A * | 5/1980 | Bice et al. | 439/139 |
| 4,254,403 | A * | 3/1981 | Perez-Cavero et al. | 375/259 |
| 4,340,267 | A * | 7/1982 | Nukaga | 439/141 |
| 4,371,867 | A * | 2/1983 | Gander | 307/3 |
| 4,377,804 | A * | 3/1983 | Suzuki | 375/356 |
| 4,398,178 | A * | 8/1983 | Russ et al. | 307/3 |
| 4,400,688 | A * | 8/1983 | Johnston et al. | 307/3 |
| 4,403,824 | A * | 9/1983 | Scott | 439/680 |
| 4,411,491 | A * | 10/1983 | Larkin et al. | 385/73 |
| 4,445,739 | A * | 5/1984 | Wooten | 439/140 |
| 4,682,848 | A * | 7/1987 | Cairns et al. | 385/69 |
| 4,797,116 | A * | 1/1989 | Isohata et al. | 439/141 |
| 4,808,127 | A * | 2/1989 | Swanic | 439/139 |
| 4,832,613 | A * | 5/1989 | Tsukakoshi | 439/141 |
| 4,887,883 | A * | 12/1989 | Darbut et al. | 385/58 |
| 5,030,119 | A * | 7/1991 | Lowe | 439/141 |
| 5,046,961 | A * | 9/1991 | Hoffman | 439/141 |
| 5,125,056 | A * | 6/1992 | Hughes et al. | 385/59 |
| 5,167,516 | A * | 12/1992 | Tan et al. | 439/141 |
| 5,194,012 | A * | 3/1993 | Cairns | 439/201 |
| 5,203,805 | A * | 4/1993 | Cairns | 439/199 |
| 5,222,907 | A * | 6/1993 | Katabuchi et al. | 439/377 |
| 5,234,350 | A * | 8/1993 | Marechal et al. | 439/139 |
| 5,252,082 | A * | 10/1993 | Hsieh et al. | 439/141 |
| 5,334,032 | A * | 8/1994 | Myers et al. | 439/140 |
| 5,412,550 | A * | 5/1995 | Hsieh et al. | 362/641 |
| 5,437,558 | A * | 8/1995 | Sakuraoka et al. | 439/140 |
| 5,466,164 | A * | 11/1995 | Miyazaki et al. | 439/140 |
| 5,501,606 | A * | 3/1996 | Oda et al. | 439/140 |
| 5,518,411 | A * | 5/1996 | Belleci | 439/141 |
| 5,645,438 | A * | 7/1997 | Cairns | 439/139 |
| 5,645,442 | A * | 7/1997 | Cairns | 439/201 |
| 5,666,829 | A * | 9/1997 | Aikens | 70/57 |
| 5,685,727 | A * | 11/1997 | Cairns | 439/139 |
| 5,691,691 | A * | 11/1997 | Merwin et al. | 375/259 |
| 5,722,842 | A * | 3/1998 | Cairns | 439/139 |
| 5,730,626 | A * | 3/1998 | Tomita et al. | 439/595 |
| 5,738,535 | A * | 4/1998 | Cairns | 439/138 |
| 5,772,457 | A * | 6/1998 | Cairns | 439/201 |
| 5,779,491 | A * | 7/1998 | Nagano et al. | 439/141 |
| 5,870,016 | A * | 2/1999 | Shrestha | 375/222 |
| 5,873,750 | A * | 2/1999 | Cairns et al. | 439/587 |
| 5,961,337 | A * | 10/1999 | Kordes | 439/141 |
| 5,993,255 | A * | 11/1999 | Yurko | 439/595 |
| 6,017,227 | A * | 1/2000 | Cairns et al. | 439/138 |
| 6,039,585 | A * | 3/2000 | Kim et al. | 439/137 |
| 6,062,881 | A * | 5/2000 | Ellison | 439/141 |
| 6,095,838 | A * | 8/2000 | Brickett | 439/201 |
| 6,139,338 | A * | 10/2000 | Hirai et al. | 439/141 |
| 6,231,358 | B1 * | 5/2001 | Kerr et al. | 439/140 |
| 6,315,461 | B1 * | 11/2001 | Cairns | 385/56 |
| 6,390,834 | B1 * | 5/2002 | Hofmeister et al. | 439/140 |
| 6,409,525 | B1 * | 6/2002 | Hoelscher et al. | 439/140 |
| 6,422,881 | B1 * | 7/2002 | Puhl et al. | 439/140 |
| 6,464,405 | B2 * | 10/2002 | Cairns et al. | 385/56 |
| 6,464,522 | B2 * | 10/2002 | Osawa et al. | 439/271 |
| 6,468,095 | B2 * | 10/2002 | Kerr et al. | 439/140 |
| 6,549,120 | B1 * | 4/2003 | de Buda | 370/482 |
| 6,604,954 | B2 * | 8/2003 | Chu et al. | 439/140 |
| 6,623,285 | B2 * | 9/2003 | Nishide | 439/140 |
| 6,692,274 | B2 * | 2/2004 | Maegawa | 439/157 |
| 6,733,311 | B2 * | 5/2004 | Kameda | 439/140 |
| 6,736,545 | B2 * | 5/2004 | Cairns et al. | 385/56 |
| 6,761,568 | B2 * | 7/2004 | Bakker et al. | 439/140 |
| 6,767,238 | B2 * | 7/2004 | Kitadai | 439/378 |
| 6,770,986 | B2 * | 8/2004 | Nagao et al. | 307/326 |
| 6,837,727 | B2 * | 1/2005 | Migimatsu et al. | 439/247 |
| 6,846,191 | B2 * | 1/2005 | Hobbs et al. | 439/157 |
| 6,875,027 | B2 * | 4/2005 | Ye et al. | 439/74 |
| 6,896,531 | B2 * | 5/2005 | Bakker et al. | 439/140 |
| 6,910,910 | B2 * | 6/2005 | Cairns | 439/352 |
| 6,976,858 | B1 * | 12/2005 | Kikuchi et al. | 439/140 |
| 7,086,880 | B2 * | 8/2006 | Uchida | 439/141 |
| 7,112,080 | B2 * | 9/2006 | Nicholson | 439/283 |
| 7,125,269 | B2 * | 10/2006 | Ohta et al. | 439/140 |
| 7,134,901 | B2 * | 11/2006 | Okura | 439/372 |
| 7,140,891 | B1 * | 11/2006 | Huang et al. | 439/137 |
| 7,210,948 | B2 * | 5/2007 | Nishide | 439/157 |
| 7,223,108 | B2 * | 5/2007 | Chiang et al. | 439/137 |
| 7,244,132 | B1 * | 7/2007 | Cairns et al. | 439/191 |
| 7,344,316 | B2 * | 3/2008 | McKinnon | 385/56 |
| 7,364,448 | B2 * | 4/2008 | Cairns et al. | 439/201 |
| 7,391,168 | B1 * | 6/2008 | Dernovsek et al. | 315/291 |
| 7,429,197 | B2 * | 9/2008 | Weis et al. | 439/680 |
| 7,588,446 | B2 * | 9/2009 | Kobayashi | 439/135 |
| 7,661,990 | B1 * | 2/2010 | Chiang | 439/607.35 |
| 7,670,177 | B2 * | 3/2010 | Myer et al. | 439/595 |
| 7,695,294 | B2 * | 4/2010 | Lu | 439/141 |
| 7,766,677 | B2 * | 8/2010 | Chiang | 439/140 |
| 7,843,145 | B2 * | 11/2010 | McKenzie et al. | 315/291 |
| 7,845,966 | B2 * | 12/2010 | Rioufreyt et al. | 439/367 |
| 8,011,941 | B2 * | 9/2011 | Sadick et al. | 439/271 |
| 8,038,455 | B1 * | 10/2011 | Moraes et al. | 439/140 |
| 8,075,325 | B1 * | 12/2011 | Kao et al. | 439/205 |
| 8,147,261 | B2 * | 4/2012 | Horiuchi | 439/157 |
| 8,192,089 | B2 * | 6/2012 | Cairns et al. | 385/53 |
| 8,366,462 | B2 * | 2/2013 | Kuo | 439/131 |
| 2001/0034147 | A1 * | 10/2001 | Kerr et al. | 439/141 |
| 2002/0003931 | A1 * | 1/2002 | Cairns et al. | 385/56 |
| 2002/0025703 | A1 * | 2/2002 | Chen | 439/141 |
| 2002/0036432 | A1 | 3/2002 | Nagao et al. | |
| 2003/0007738 | A1 * | 1/2003 | Cairns et al. | 385/56 |
| 2003/0008537 | A1 * | 1/2003 | Nishide | 439/157 |
| 2003/0077930 | A1 * | 4/2003 | Chu et al. | 439/140 |
| 2003/0119348 | A1 * | 6/2003 | Kameda | 439/137 |
| 2003/0119349 | A1 * | 6/2003 | Bakker et al. | 439/140 |
| 2005/0059280 | A1 * | 3/2005 | Hobbs et al. | 439/140 |
| 2006/0154505 | A1 * | 7/2006 | Nishide | 439/157 |
| 2006/0270254 | A1 * | 11/2006 | Chiang et al. | 439/137 |
| 2006/0270255 | A1 * | 11/2006 | Ishikawa et al. | 439/141 |
| 2007/0131784 | A1 * | 6/2007 | Garozzo et al. | 236/51 |
| 2011/0237098 | A1 * | 9/2011 | Tajima | 439/140 |

FOREIGN PATENT DOCUMENTS

| | | |
|---|---|---|
| EP | 0 339 876 A1 | 11/1989 |
| JP | 01-316711 | 12/1989 |
| JP | 01-316711 A | 12/1989 |
| JP | 02-15173 U | 2/1992 |
| JP | 2001-306191 | 11/2001 |
| JP | 2002-110283 | 4/2002 |
| JP | 2002-110283 A | 4/2002 |
| WO | WO 00 46881 A1 | 8/2000 |

OTHER PUBLICATIONS

Notice of Reasons for Refusal of Japanese patent application No. 2008-322547, dated Jan. 8, 2013.

English Language European Search Report in corresponding EP 09 83 3304, mailed Feb. 4, 2012.

* cited by examiner

PLUG, PLUG RECEPTACLE AND ELECTRIC POWER SUPPLYING SYSTEM

CROSS REFERENCE TO RELATED APPLICATIONS

This application is a national phase application based on PCT/JP2009/069259, filed Nov. 12, 2009, which claims the priority of Japanese Patent Application No. 2008-322547, filed Dec. 18, 2008, the content of both of which is incorporated herein by reference.

TECHNICAL FIELD

The present invention relates to a plug, a plug receptacle and an electric power supplying system.

BACKGROUND ART

Many electronic devices, such as personal computers and game consoles, use an AC adapter that inputs alternating current (AC) electric power from a commercial power source and outputs electric power in accordance with the device, in order to operate and charge the device. Normally, electronic devices are operated using direct current (DC), and voltage and current are different according to each device. Therefore, a specification of the AC adapter to output electric power in accordance with the device also differs with each device. Thus, even if an AC adapter has a same kind of shape, there are problems with a lack of compatibility and an increase in a number of the AC adapters in line with an increase in the devices.

With respect to these kind of problems, a power source bus system has been proposed in which a power source supply block, which supplies electric power to a device such as a battery or an AC adapter, and a power consumption block, which is supplied with the electric power from the power source supply block, are connected to a single common direct current bus line (as disclosed, for example, in Patent Literature 1). In this power source bus system, direct current is flowing through the bus line. Further, in the power source bus system, each block itself is described as an object and each of the block objects mutually transmits and receives information (status data) via the bus line. In addition, each of the block objects generates information (status data) based on a request from another of the block objects, and transmits the status data as response data. Then, the block object that has received the response data can control the electric power supply and consumption based on the content of the received response data.

CITATION LIST

Patent Literature

Patent Literature 1: Japanese Patent Application Publication No. JP-A-2001-306191

SUMMARY OF INVENTION

Technical Problem

In this type of power source bus system, the power supply block and the power consumption block are connected using a bus line and a plug to which electric power is supplied. In known electronic devices that receive supply of AC electric power, when the electronic devices are consuming electric power and are also in the vicinity of an AC peak value, if the plug is removed from an outlet (a plug receptacle), a spark occurs between the outlet and the plug. It is conceivable that the occurrence of spark constantly occurs in the power source bus system to which DC electric power or low frequency AC electric power is supplied. The occurrence of spark leads to a problem of deterioration of the plug and the outlet. Therefore, in electronic devices in the electric power supplying system in which an information signal is superimposed on electric power and is supplied, it is necessary to allow a user to safely remove or insert the plug into the outlet.

The present invention is made in view of the above-mentioned issue, and aims to provide a plug, a plug receptacle into which the plug is inserted, and a power source bus system which are novel and improved and which are capable of being safely connected to a bus line or disconnected from the bus line in the power source bus system, by providing a structure in which electrodes are not exposed when disconnected from the bus line.

Solution to Problem

According to an aspect of the present invention in order to achieve the above-mentioned object, there is provided a plug that includes at least two electrodes, a housing that supports the electrodes, an electrode cover which covers the electrodes when not inserted in a plug receptacle, and which is accommodated in the housing and exposes the electrodes when inserted in the plug receptacle, and a lock mechanism which inhibits the electrode cover from being accommodated in the housing when not inserted in the plug receptacle, and which allows the electrode cover to be accommodated in the housing when inserted into the plug receptacle.

The lock mechanism may be depressed when connected with the plug receptacle and allows the electrode cover to be accommodated in the housing.

The housing may include a reverse insertion inhibition portion that inhibits connection with a different polarity.

According to another aspect of the present invention in order to achieve the above-mentioned object, there is provided a plug receptacle that includes a cover that protects electrodes, and a lock release mechanism that releases inhibition of accommodation of an electrode cover into a housing by a lock mechanism, when a plug is inserted that includes at least two electrodes, the housing that supports the electrodes, the electrode cover which covers the electrodes when not inserted and which is accommodated in the housing and exposes the electrodes when inserted, and the lock mechanism which inhibits the electrode cover from being accommodated in the housing when not inserted and which allows the electrode cover to be accommodated in the housing when inserted.

The lock release mechanism may depress the lock mechanism and thereby releases the inhibition of accommodation into the housing by the lock mechanism.

The cover may include a reverse insertion inhibition portion that inhibits connection of the plug with a different polarity.

According to another aspect of the present invention in order to achieve the above-mentioned object, there is provided an electric power supplying system that includes a bus line which is formed by at least two conductors and on which an information signal representing information is superimposed on electric power, at least one power supply server which is connected to the bus line and which supplies the electric power, and at least one client which is connected to the bus line and which receives the supply of the electric power from the power supply server. At least one of the power supply server and the client may be provided with a plug that includes at least two electrodes, a housing that supports the electrodes, an electrode cover which covers the electrodes when not inserted in a plug receptacle and which is accommodated in the housing and exposes the electrodes when inserted in the plug receptacle, and a lock mechanism which inhibits the electrode cover from being accommodated in the housing when not inserted in the plug receptacle, and which allows the electrode cover to be accommodated in the housing when inserted into the plug receptacle. The bus line may be provided with the plug receptacle that includes a cover that protects electrodes and a lock release mechanism that, when the plug is inserted, releases the inhibition, by the lock mechanism, of accommodation of the electrode cover into the housing.

Advantageous Effects of Invention

According to the present invention described above, there is provided a plug, a plug receptacle into which the plug is inserted, and a power source bus system which are novel and improved and which are capable of being safely connected to a bus line or disconnected from the bus line in the power source bus system to which DC electric power or low frequency AC electric power is supplied, by providing a structure in which electrodes are not exposed when disconnected from the bus line.

DESCRIPTION OF EMBODIMENTS

Hereinafter, preferred embodiments of the present invention will be described in detail with reference to the appended drawings. Note that, in this specification and the drawings, elements that have substantially the same function and structure are denoted with the same reference signs, and repeated explanation is omitted.

Note that the preferred embodiment of the present invention will be described in detail in the following order:

[1] Structure of electric power supplying system

[2] Structure of power supply server

[3] Structure of client

[4] Electric power supply processing by the electric power supplying system

[5] Structure of outlet (plug receptacle) according to embodiment of the present invention

[6] Structure of plug according to embodiment of the present invention

[7] Change in shape of plug when plug is inserted into outlet

[8] Conclusion

[1] STRUCTURE OF ELECTRIC POWER SUPPLYING SYSTEM

Figure 1:
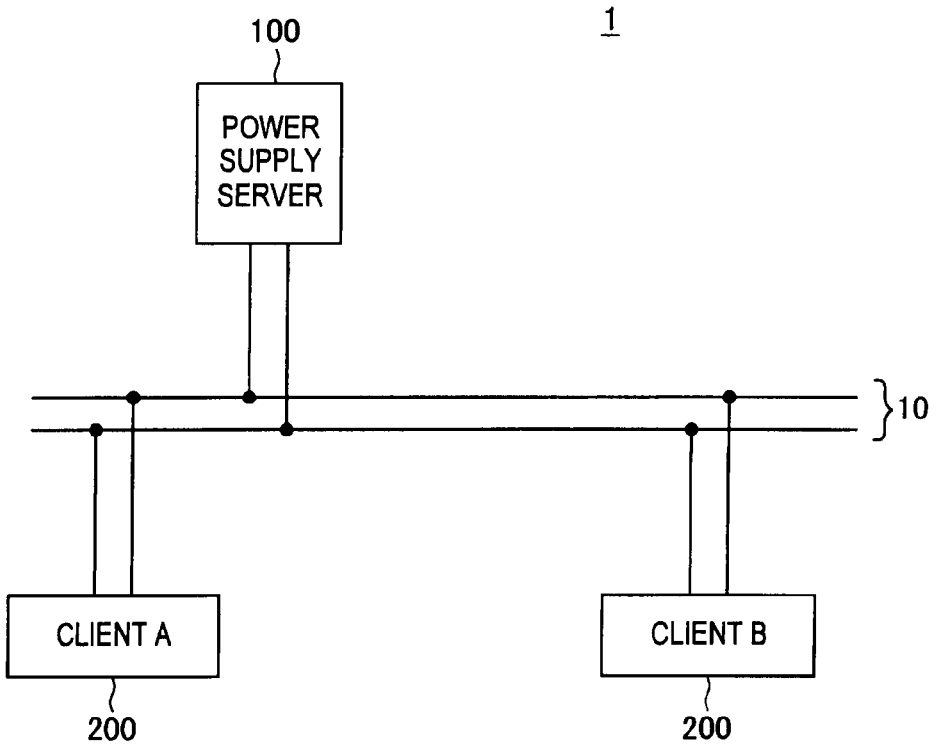
FIG. 1 is an explanatory diagram illustrating a structure of an electric power supplying system according to an embodiment of the present invention.

First, a structure of an electric power supplying system using plug according to an embodiment of the present invention will be described. FIG. 1 is an explanatory diagram illustrating the structure of the electric power supplying system according to the embodiment of the present invention. Hereinafter, the structure of the electric power supplying system according to the embodiment of the present invention will be explained with reference to FIG. 1.

As shown in FIG. 1, an electric power supplying system 1 according to the embodiment of the present invention includes a power supply server 100 and clients 200. The power supply server 100 and the clients 200 are connected via a bus line 10.

The power supply server 100 supplies direct current electric power to the clients 200. Further, the power supply server 100 transmits and receives information signals to and from the clients 200. In the present embodiment, the bus line 10 is commonly used both for the supply of direct current electric power and the transmitting and receiving of information signals between the power supply server 100 and the clients 200. A structure of the power supply server 100 will be explained below.

The clients 200 receive the supply of direct current electric power from the power supply server 100. Further, the clients 200 transmit and receive the information signals with the power supply server 100. A structure of the client 200 will be explained below.

Note that the single power supply server 100 and two of the clients 200 are exemplified in the electric power supplying system 1 shown in FIG. 1, but it is needless to say that in the present invention, a number of the power supply servers and a number of the clients are not limited to this example.

Above, the structure of the electric power supplying system according to the embodiment of the present invention is explained using FIG. 1. Next, a structure of the power supply server 100 according to the embodiment of the present invention will be explained.

[2] STRUCTURE OF POWER SUPPLY SERVER

Figure 2:
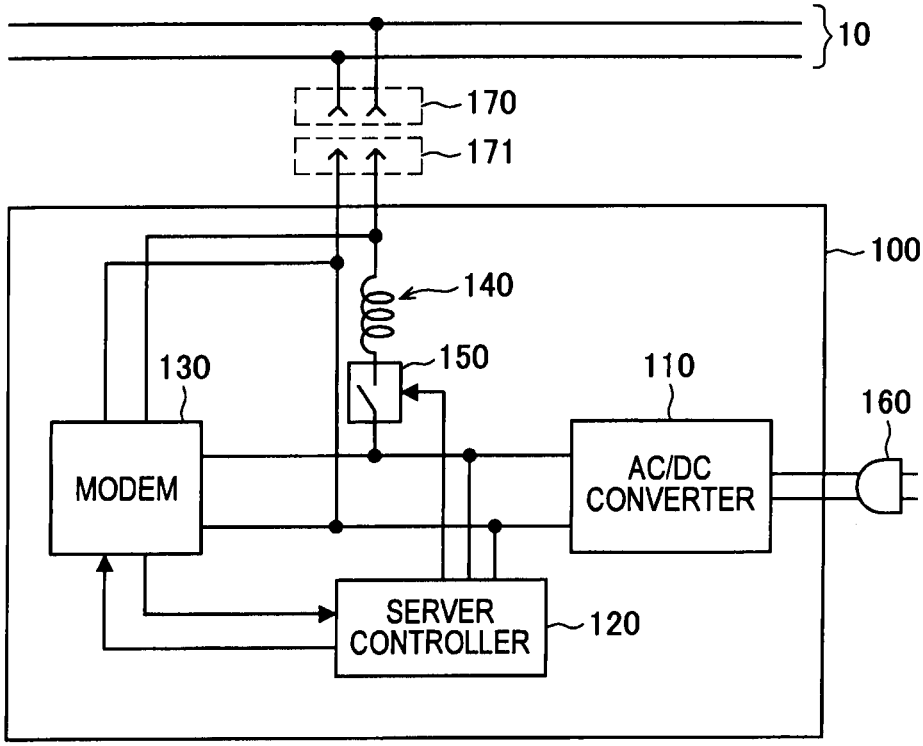
FIG. 2 is an explanatory diagram illustrating a structure of a power supply server 100 according to the embodiment of the present invention.

FIG. 2 is an explanatory diagram illustrating the structure of the power supply server 100 according to the embodiment of the present invention. Hereinafter, the structure of the power supply server 100 according to the embodiment of the present invention will be explained with reference to FIG. 2.

As shown in FIG. 2, the power supply server 100 according to the embodiment of the present invention includes an AC/DC converter 110, a server controller 120, a modem 130, an inductor 140, a switch 150 and a plug 171.

The AC/DC converter 110 is an alternating current/direct current converter portion that converts alternating current electric power supplied from a commercial power source 160 to direct current electric power such that it can be supplied to the client 200. The electric power that has been converted from alternating current to direct current by the AC/DC converter 110 is supplied to the client 200 via the bus line 10. Note that the inductor 140 and the switch 150 are provided between the AC/DC converter 110 and one of the bus lines 10, as shown in FIG. 2. The inductor 140 is provided such that impedance on a communication path is not lowered by a bypass condenser that is normally provided in an output portion of the AC/DC converter 110. Further, the switch 150 is provided in order that electric power is not suddenly output from the power supply server 100 to the bus line 10.

The server controller 120 is a control portion to execute various functions in order to supply electric power by the power supply server 100. The server controller 120 is formed, for example, of a micro processor and peripheral circuits to operate the micro processor. Controls executed by the server controller 120 include, for example, control of whether or not to connect electric power supplied from the AC/DC converter to the bus line 10 and control of a communication protocol for communication with the client 200. In addition, controls executed by the server controller 120 include, for example, control of transmission and reception of information signals to and from the client 200. Furthermore, the server controller 120 is provided with a storage portion (not shown in the figures), which stores, as internal information, the electric power specification (a server profile), a protocol for the information signals, and information of the client 200 acquired by communication and so on.

The modem 130 makes possible the transmission and reception of information signals between the power supply server 100 and the client 200 via the bus line 10. In the electric power supplying system 1 according to the present embodiment, information signals and electric power share a same pair of conductors. Thus, so that electrical interference does not occur, it is necessary to separate the information signals and the electric power through frequency division. In the electric power supplying system 1 according to the present embodiment, the transmission and reception of the information signals between the power supply server and the client 200 is performed via the bus line 10. The transmission and reception of the information signals is performed using a sufficiently high frequency bandwidth, such that electrical interference does not occur with a frequency bandwidth that is used to deliver the electric power (a low frequency bandwidth of around 400 Hz or below, for example). The modem 130 performs signal modulation and demodulation in the transmission and reception of the information signals, which are performed using the sufficiently high frequency bandwidth.

The plug 171 connects the power supply server 100 and the bus line 10 by being inserting into an outlet 170 provided on the bus line 10. The structure of the outlet 170 and the plug 171 will be described later.

The structure of the power supply server 100 according to the embodiment of the present invention is explained above. Next, a structure of the client 200 according to the embodiment of the present invention will be explained.

[3] STRUCTURE OF CLIENT

Figure 3:
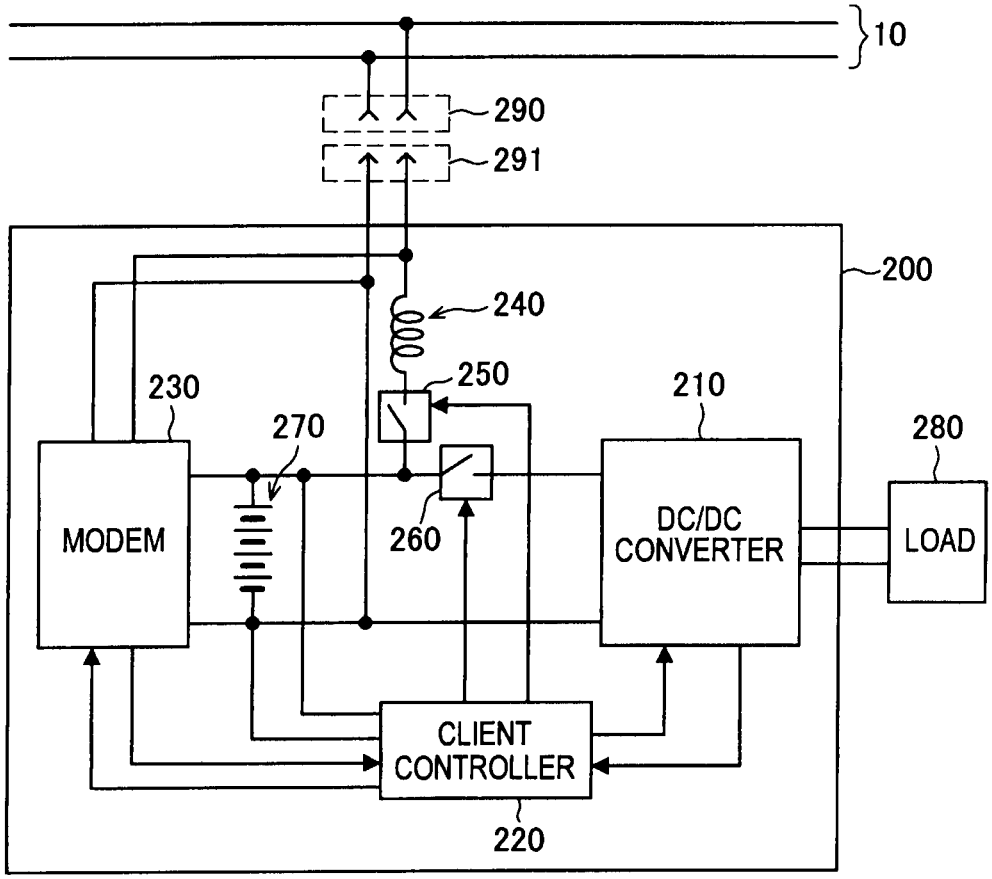
FIG. 3 is an explanatory diagram illustrating a structure of a client 200 according to the embodiment of the present invention.

FIG. 3 is an explanatory diagram illustrating the structure of the client 200 according to the embodiment of the present invention. Hereinafter, the structure of the client 200 according to the embodiment of the present invention will be explained with reference to FIG. 3.

As shown in FIG. 3, the client 200 according to the embodiment of the present invention includes a DC/DC converter 210, a client controller 220, a modem 230, an inductor 240, switches 250 and 260, a battery 270, an outlet 290 and a plug 291.

The DC/DC converter 210 converts the direct current electric power supplied from the power supply server 100 to an electric current and voltage required by a load 280 that is connected to the client 200. Further, as shown in FIG. 3, the inductor 240 and the switches 250 and 260 are provided between the DC/DC converter 210 and one of the bus lines 10. The inductor and switches function similarly to the inductor 140 and the switch 150 of the above-described power supply server 100.

The client controller 220 executes various functions in order for the client 200 to receive the electric power supply. Similarly to the above-described server controller 120, the client controller 220 is formed, for example, of a micro processor and peripheral circuits to operate the micro processor. The client controller 220, for example, determines how to consume the electric power supplied from the power supply server 100 and performs control of a protocol used in communication of information signals to and from the power supply server 100. Further, the client controller 220 is provided with a storage portion (not shown in the figures), which stores, as internal information, a protocol for the transmission and reception of the information signals, client information relating to the specification of the client 200 (a client power profile) and so on.

The modem 230 makes possible the transmission and reception of information signals between the power supply server 100 and the client 200 via the bus line 10. In a similar manner to the above-described modem 130, the modem 230 performs signal modulation and demodulation in the transmission and reception of the information signals, which are performed using the sufficiently high frequency bandwidth.

Note that when the consumed electric power of the load 280 is zero or is low, the client 200 can accumulate the electric power supplied by the power supply server 100 in the battery 270.

The plug 291 connects the power supply server 100 and the bus line 10 by being inserting into the outlet 290 provided on the bus line 10.

The structure of the client 200 according to the embodiment of the present invention is explained above. Next, an electric power supply processing by the electric power supplying system 1 according to the embodiment of the present invention will be explained, and subsequently the structure of the outlet 170, 290 and the plug 171, 291, which are used for the power supply server 100 and the clients 200 will be explained.

[4] ELECTRIC POWER SUPPLY PROCESSING BY THE ELECTRIC POWER SUPPLYING SYSTEM

In the electric power supplying system 1 according to the embodiment of the present invention, the electric power supply processing from the power supply server 100 to the client 200 is performed based on synchronous packets that are periodically output from the power supply server 100 to the bus line 10. The client 200 is aware of the existence of the power supply server 100 by the synchronous packets delivered through the bus line 10, and can access the power supply server 100. When the power supply server 100 receives access from the client 200, the power supply server 100 transmits its own address to the client 200. When the client 200 receives the address of the power supply server 100, the client 200 transmits to the power supply server 100, addressed to the received address, an information signal that requests the supply of electric power. When the power supply server 100 receives the information signal requesting the supply of electric power from the client 200, the power supply server 100 supplies the electric power to the client 200.

Figure 8:
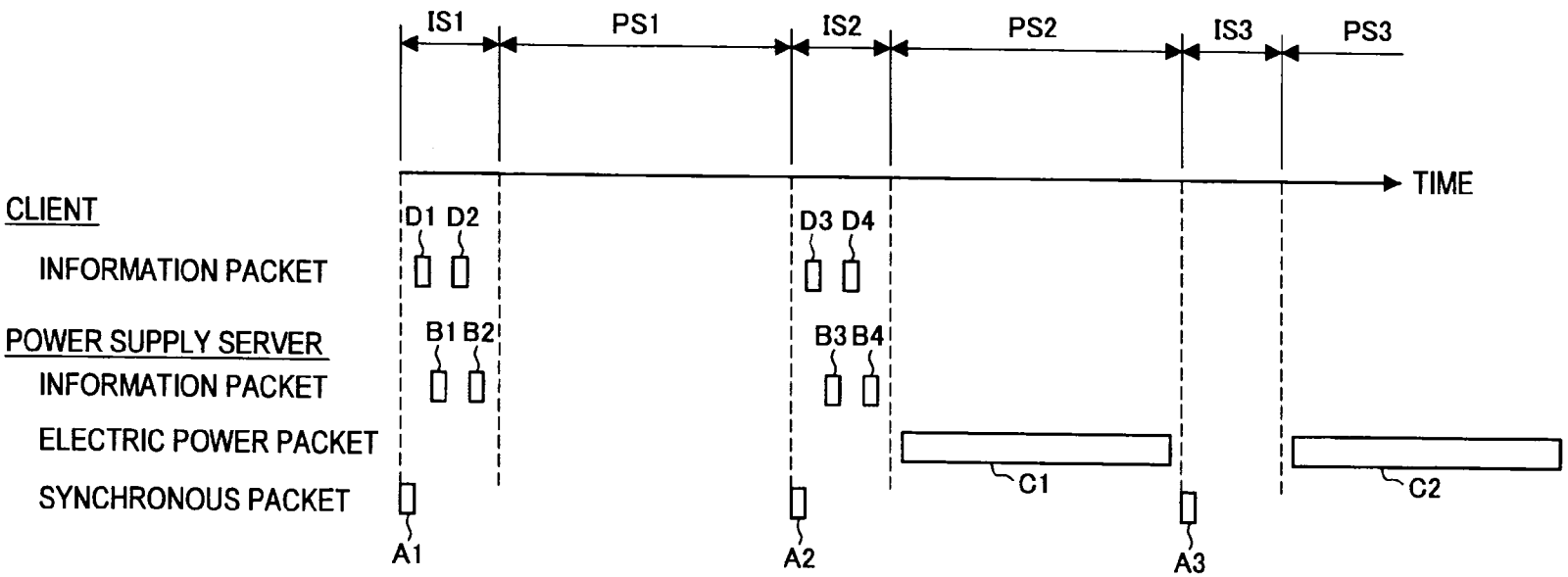
FIG. 8 is an explanatory diagram illustrating electric power supply processing by the electric power supplying system 1 according to the embodiment of the present invention.

FIG. 8 is an explanatory diagram illustrating the electric power supply processing by the electric power supplying system 1 according to the embodiment of the present invention. Hereinafter, the electric power supply processing of the electric power supplying system 1 according to the embodiment of the present invention will be explained in more detail with reference to FIG. 8. Regarding the electric power supply processing of the electric power supplying system 1 according to the embodiment of the present invention, it would be helpful to refer to an invention disclosed in JP2008-123051A1 described by the same inventor of this application.

As shown in FIG. 11, the power supply server 100 periodically outputs synchronous packets A1, A2, A3 and so on to the bus line 10. Further, in order to supply electric power to the client 200, the power supply server 100 outputs information packets B1, B2, B3 and so on, which are information signals transmitted and received to and from the client 200, and also outputs electric power packets C1, C2, C3 and so on, which are packetized electric power energy. Meanwhile, in order to receive the supply of electric power from the power supply server 100, the client 200 outputs information packets D1, D2, D3 and so on, which are information signals transmitted and received to and from the power supply server 100.

The power supply server 100 outputs the synchronous packets A1, A2, A3 and so on at a start time of a time slot of a predetermined interval (a one second interval, for example). The time slot is formed of an information slot in which an information packet is transmitted, and an electric power slot in which an electric power packet is transmitted. Information slots IS1, IS2, IS3 and so on are intervals during which exchange of the information packets is performed between the power supply server 100 and the client 200. Further, power supply slots PS1, PS2, PS3 and so on are intervals in which the electric power packets C1, C2, C3 and so on supplied from the power supply server 100 to the client 200 are output. The information packets are packets that can only be output in the intervals of the information slots IS1, IS2, IS3 and so on. Therefore, when it is not possible to complete transmission and reception of the information packet during one of the information slots, the information packet is transmitted over a plurality of the information slots. Meanwhile, the electric power packets are packets that can only be output in the intervals of the power supply slots PS1, PS2, PS3 and so on.

The power supply server 100 has one, or two or more, server power profiles that indicate an electric power specification at which the power supply server 100 itself can supply electric power. The client 200 receives the supply of electric power from the power supply server 100 that is able to supply the electric power that matches a specification of the client 200. At this time, the client 200 acquires the server power profiles from the power supply server 100 and decides the specification of the power supply server 100 (the server power profile) for itself. At that time, first, the client 200 detects the synchronous packet A1 output by the power supply server 100 and acquires the address of the power supply server 100 that is included in the synchronous packet A1. The address can be, for example, a MAC address. Next, the client 200 transmits the information packet D1 to the power supply server 100 to request transmission of a number of the server power profiles that the power supply server 100 has.

When the power supply server 100 receives the information packet D1, the power supply server 100 transmits, in the information packet B1, a server power profile number that is the number of server power profiles that the power supply server 100 has. When the client 200 receives the information packet B1, the client 200 acquires, from the power supply server 100, content of the server power profiles for the number of server power profiles of the power supply server 100. For example, when the power supply server 100 has two server power profiles, the client 200 first acquires an initial one of the server power profiles. When the client 200 acquires the initial one of the server power profiles, the client 200 transmits to the power supply server 100, as the information packet D2, a request to use electric power.

When the power supply server 100 receives the information packet D2, the power supply server 100 transmits to the client 200, as the information packet B2, a first server power profile that is stored in the storage portion (not shown in the figures) of the server controller 120. When the client 200 receives the information packet B2 from the power supply server 100, the client 200 transmits an information packet in order to acquire a second server power profile. However, at this point in time, the information slot IS1 ends, and the power supply slot PS1 to transmit a power supply packet starts. Thus, the information packet is transmitted in the next information slot IS2. Further, in the power supply slot PS1, as the client 200 has not confirmed the electric power supply specification to receive the supply from the power supply server 100, electric power supply is not carried out.

When the power supply slot PS1 ends, the synchronous packet A2 indicating the start of the next time slot is output from the power supply server 100. After that, when the client 200 receives the information packet B2 from the power supply server 100, the client 200 transmits, as the information packet D3, information to acquire the second server power profile.

When the power supply server 100 receives the information packet D3, the power supply server 100 transmits to the client 200, as the information packet B3, the second server power profile that is stored in the storage portion (not shown in the figures) of the server controller 120. When the client 200 receives the information packet B3 and acquires the two server power profiles that the power supply server 100 has, the client 200 selects the server power profile of the power supply specification that is compatible with itself. The client 200 then transmits, to the power supply server 100, an information packet D4 that causes the selected server power profile to be confirmed.

When the power supply server 100 receives the information packet D4, in order to notify the client 200 that the first server power profile has been confirmed, the power supply server 100 transmits, as an information packet B4 to the client 200, information representing a response that indicates that the electric power supply specification has been confirmed. After that, when the information slot IS2 ends and the power supply slot PS2 starts, the power supply server 100 outputs the power supply packet C1 to the client 200 and performs supply of electric power. Note that, with respect to a transmission timing of the electric power packet, an electric power supply start time can be specified from the client 200 to the power supply server 100 by using information representing a transmission start time setting request.

The electric power supply processing by the electric power supplying system 1 according to the embodiment of the present invention is described above. Next, the structure of the plugs 171 and 291 will be explained, which are used for the power supply server 100 and the clients 200 in the electric power supplying system 1 according to the embodiment of the present invention. Note that, in the description below, although only the outlet 170 and the plug 171 will be explained as an example, the structure that will be explained below can also be applied to the outlet 290 and the plug 291.

[5] STRUCTURE OF OUTLET (PLUG RECEPTACLE) ACCORDING TO EMBODIMENT OF THE PRESENT INVENTION

Figure 4A:
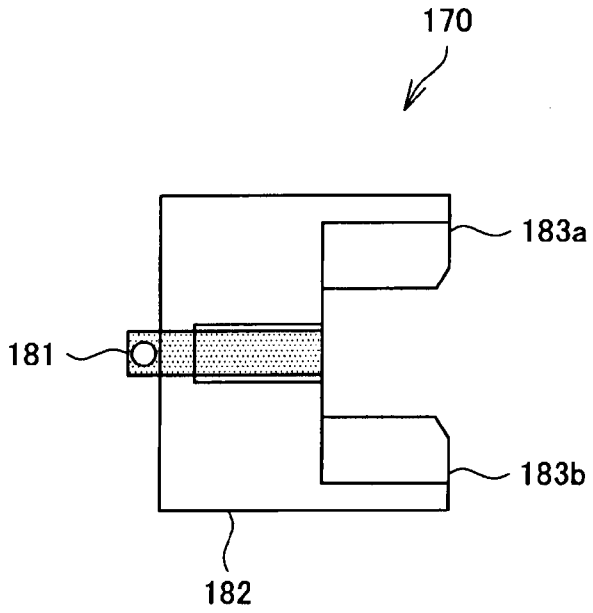
FIG. 4A is an explanatory diagrams illustrating the structure of the outlet 170 according to the embodiment of the present invention.
Figure 4B:
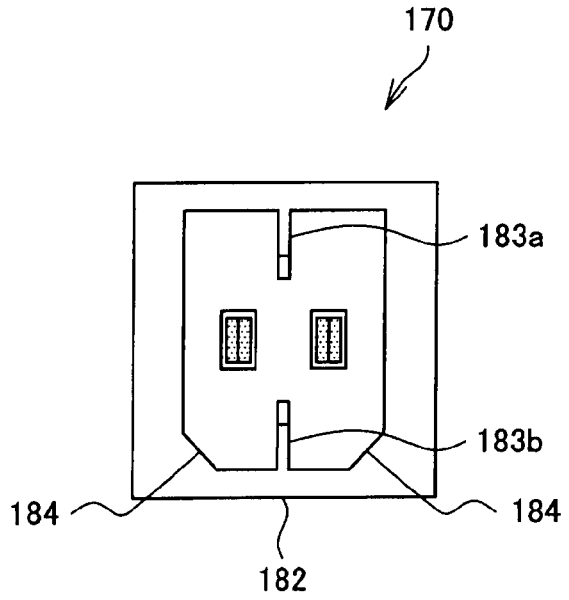
FIG. 4B is an explanatory diagrams illustrating the structure of the outlet 170 according to the embodiment of the present invention.

FIG. 4A and FIG. 4B are explanatory diagrams illustrating the structure of the outlet 170 according to the embodiment of the present invention. FIG. 4A is an explanatory diagram showing a cross section of the outlet 170 according to the embodiment of the present invention when viewed from a direction of a right side surface. FIG. 4B is an explanatory diagram when the outlet 170 is viewed from an electrode direction. Hereinafter, the structure of the outlet 170 according to the embodiment of the present invention will be explained using FIG. 4A and FIG. 4B.

As shown in FIG. 4A and FIG. 4B, the outlet 170 according to the embodiment of the present invention is structured such that it includes a pair of electrodes 181, a cover 182 formed of an insulator, lock release mechanisms 183*a* and 183*b*, and inclined portions 184.

The electrodes 181 are female electrodes that are structured such that they can be in contact with plug electrodes, which will be described later. The electrodes 181 are similar to female electrodes that are currently in widespread use and that are used in an outlet that supplies AC electric power. The electrodes 181 are connected to the bus line 10. However, a method for connecting the electrodes 181 with the bus line 10 and a method for insulating a connection point do not have a direct relationship with the present invention, and a detailed explanation thereof is therefore omitted. The cover 182 is formed of an insulator as described above. The inclined portions 184, which are an example of a reverse insertion inhibition portion of the present invention, are formed on the cover 182 in order to inhibit plug insertion with a reverse polarity. Note that, although the two inclined portions 184 are provided in FIG. 4B, it is needless to mention that, in the present invention, the shape of the outlet is not limited to that shown in FIG. 4B as long as it inhibits plug insertion with a reverse polarity. For example, in place of the inclined portions 184, the outlet may be formed to have a stair shape or an arc shape as the reverse insertion inhibition portion.

The lock release mechanisms 183*a* and 183*b* are formed integrally with the cover 182, and they release a lock of a cover that inhibits exposure of the electrodes in the plug 171, which will be described later, when the plug 171 is inserted into the outlet 170.

The structure of the outlet 170 according to the embodiment of the present invention is explained above. Next, the structure of the plug, which is used by being inserted into the outlet 170 according to the embodiment of the present invention, will be explained.

[6] STRUCTURE OF PLUG ACCORDING TO EMBODIMENT OF THE PRESENT INVENTION

Figure 5A:
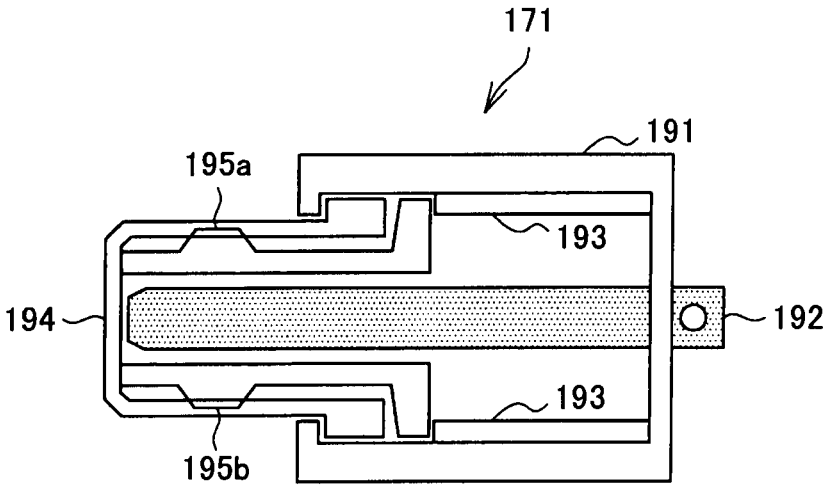
FIG. 5A is an explanatory diagrams illustrating the structure of the plug 171 according to the embodiment of the present invention.
Figure 5B:
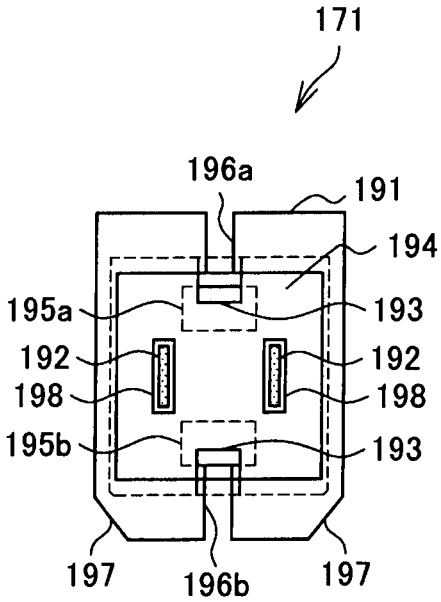
FIG. 5B is an explanatory diagrams illustrating the structure of the plug 171 according to the embodiment of the present invention.
Figure 5C:
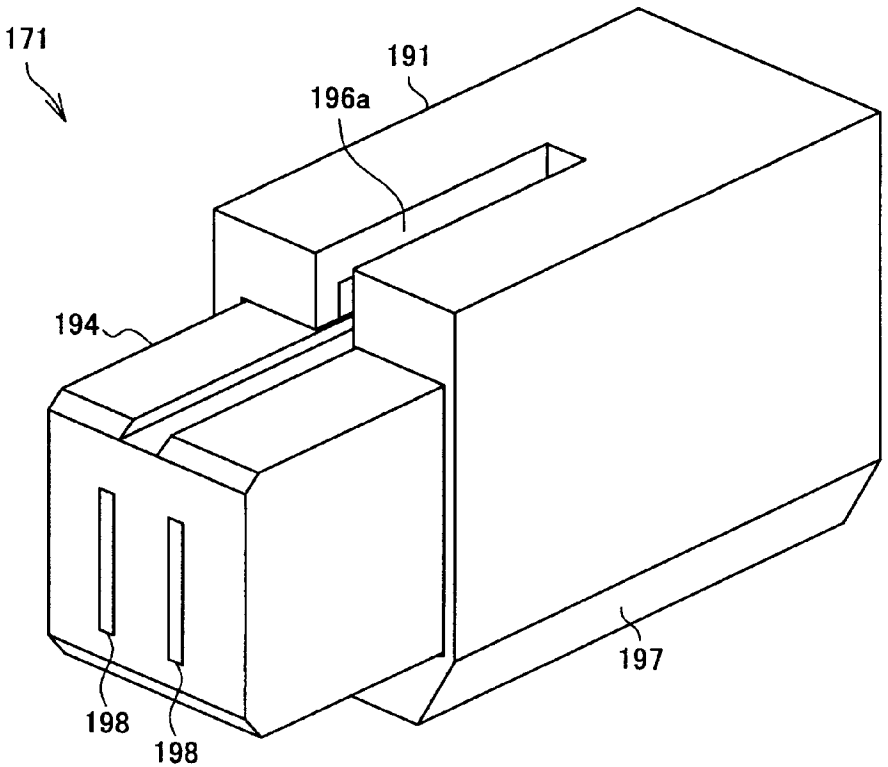
FIG. 5C is an explanatory diagrams illustrating the structure of the plug 171 according to the embodiment of the present invention.

FIG. 5A, FIG. 5B and FIG. 5C are explanatory diagrams illustrating the structure of the plug 171 according to the embodiment of the present invention. FIG. 5A is an explanatory diagram showing a cross section of the plug 171 according to the embodiment of the present invention when viewed from a direction of a right side surface. FIG. 5B is an explanatory diagram when the plug 171 is viewed from an electrode direction. In FIG. 5C, the plug 171 is shown as a perspective view. Hereinafter, the structure of the plug 171 according to the embodiment of the present invention will be explained using FIG. 5A, FIG. 5B and FIG. 5C.

As shown in FIG. 5A and FIG. 5B, the plug 171 according to the embodiment of the present invention is structured such that it includes a housing 191, a pair of electrodes 192, protruding portions 193, an electrode protection cover 194, lock mechanisms 195*a* and 195*b*, recessed portions 196*a* and 196*b*, cutaway portions 197 and electrode holes 198.

The housing 191 is formed such that it can accommodate the electrode protection cover 194, which will be described later, when the plug 171 is inserted into the outlet 170. The housing 191 is formed in such a shape that it can be engaged with the cover 182 of the plug 171. Further, in order to inhibit insertion into the outlet 170 with a reverse polarity, the housing 191 is provided with the cutaway portions 197, which are an example of the reverse insertion inhibition portion of the present invention. Note that it is desirable that the shape of the cutaway portions 197 is formed to match the shape of the inclined portions 184 in the outlet 170. Note that it is needless to mention that, in the present embodiment, the shape of the cutaway portions is not limited to that shown in FIG. 5A and so on.

The electrodes 192 are knife-shaped electrodes that are structured such that they can be in contact with the above-described electrodes 181 of the outlet 170, and they are similar to knife-shaped electrodes that are currently in widespread use and that are used in a plug that is supplied with AC electric power. The protruding portions 193 are formed inside the housing 191 as shown in FIG. 5A and FIG. 5B. The protruding portions 193 inhibit the electrode protection cover 194 from moving into the housing 191, and exposure of the electrodes 192 from the electrode holes 198 can be inhibited by the protruding portions 193.

The electrode protection cover 194 is formed of an insulating material and it protects the electrodes 192. When the plug 171 is not engaged with the outlet 170, the electrodes 192 are covered as shown in FIG. 5A so that the electrodes 192 are not exposed. Further, as described above, the electrode protection cover 194 is inhibited from moving into the housing 191 by the protruding portions 193 that are formed inside the housing 191. Note that it is desirable that, when the plug 171 is not engaged with the outlet 170, the electrodes 192 are covered, and when the plug 171 is engaged, the electrode protection cover 194 is coupled with the housing 191 using a spring or another elastic body in order to expose the electrodes 192.

The lock mechanisms 195*a* and 195*b* are provided inside the electrode protection cover 194 as shown in FIG. 5A and FIG. 5B. When the plug 171 is not engaged with the outlet 170, even when the electrode protection cover 194 is pressed from the electrode side, the electrode protection cover 194 does not slide to the inside of the housing 191 due to the lock mechanisms 195*a* and 195*b*. Then, when the plug 171 is inserted into the outlet 170, the lock mechanisms 195*a* and 195*b* are depressed to the inside of the electrode protection cover 194 by the lock release mechanisms 183*a* and 183*b* provided in the outlet 170. Because the lock mechanisms 195*a* and 195*b* are depressed to the inside of the electrode protection cover 194, the electrode protection cover 194 can move to the inside of the housing 191. The recessed portions

196*a* and 196*b* are spaces that are provided so that the lock mechanisms 195*a* and 195*b* are depressed by the lock release mechanisms 183*a* and 183*b*. The recessed portions 196*a* and 196*b* are provided so as to correspond to the positions of the lock release mechanisms 183*a* and 183*b* when the plug 171 is inserted into the outlet 170. The recessed portions 196*a* and 196*b* are provided in the housing 191 and the electrode protection cover 194, respectively. The electrode holes 198 are holes to expose the electrodes 192. When the electrode protection cover 194 slides to the inside of the housing 191, it is possible to expose the electrodes 192 from the electrode holes 198.

The structure of the plug 171 according to the embodiment of the present invention is explained above. Next, a change in the shape of the plug 171 when the plug 171 is inserted into the outlet 170 according to the embodiment of the present invention will be explained.

[7] CHANGE IN SHAPE OF PLUG WHEN PLUG IS INSERTED INTO OUTLET

Figure 6:
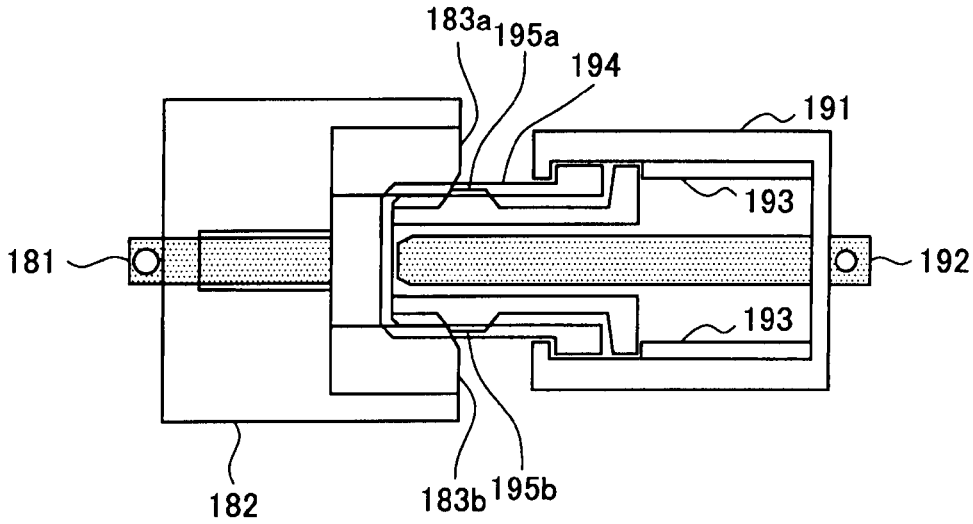
FIG. 6 is an explanatory diagram showing a state of a cross section when the plug 171 is inserted partway into the outlet 170.

FIG. 6 is an explanatory diagram showing a state of a cross section when the plug 171 is inserted partway into the outlet 170 according to the embodiment of the present invention.

As shown in FIG. 6, when the plug 171 is inserted partway into the outlet 170, the lock release mechanisms 183*a* and 183*b* come in contact with the lock mechanisms 195*a* and 195*b* because the recessed portions 196*a* and 196*b* are provided in the electrode protection cover 194.

As shown in FIG. 6, in a state where the lock release mechanisms 183*a* and 183*b* are in contact with the lock mechanisms 195*a* and 195*b*, the plug 171 is further pressed into the outlet 170. As a result of this, the lock mechanisms 195*a* and 195*b* are depressed to the inside of the electrode protection cover 194 by the lock release mechanisms 183*a* and 183*b*. Because the lock mechanisms 195*a* and 195*b* are depressed to the inside of the electrode protection cover 194, the lock of the electrode protection cover 194 by the protruding portions 193 is released, and it is possible to cause the electrode protection cover 194 to slide to the inside of the housing 191.

Figure 7:
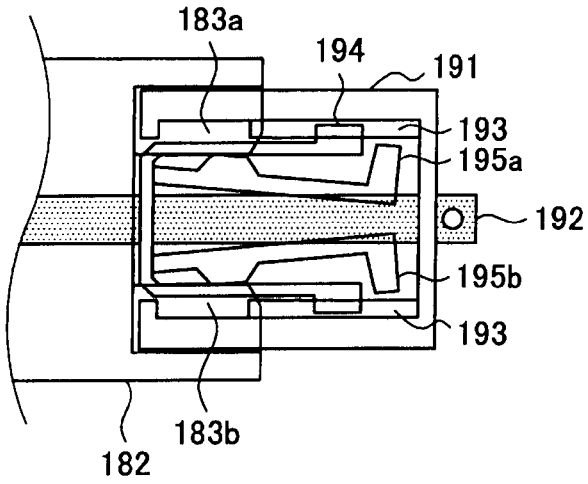
FIG. 7 is an explanatory diagram showing a state of a cross section when the plug 171 is completely inserted into the outlet 170.

FIG. 7 is an explanatory diagram showing a state of a cross section when the plug 171 is completely inserted into the outlet 170.

When the lock mechanisms 195*a* and 195*b* are depressed to the inside of the electrode protection cover 194 by the lock release mechanisms 183*a* and 183*b*, the electrode protection cover 194 is caused to slide to the inside of the housing 191 as shown in FIG. 7, and the electrodes 192 are exposed from the electrode holes 198. Because the electrode protection cover 194 is caused to slide to the inside of the housing 191 and the electrodes 192 are exposed from the electrode holes 198, the electrodes 181 and the electrodes 192 are connected, and the power supply server 100 having the plug 171 can be connected to the bus line 10.

On the other hand, when the plug 171 is removed from the outlet 170, the plug 171 is removed from the outlet 170 while holding the housing 191. In this case, when the plug 171 is partially removed from the outlet 170, the depression of the lock mechanisms 195*a* and 195*b* by the lock release mechanisms 183*a* and 183*b* is released. When the depression of the lock mechanisms 195*a* and 195*b* by the lock release mechanisms 183*a* and 183*b* is released, a state is achieved in which the electrodes 192 are accommodated in the electrode protection cover 194, as shown in FIG. 6.

The change in the shape of the plug 171 when the plug 171 is inserted into the outlet 170 according to the embodiment of the present invention is explained above.

[8] CONCLUSION

By structuring the outlet 170 and the plug 171 in this manner, the electrodes of the plug 171 are not exposed until immediately before insertion into the outlet 170. Therefore, by structuring the outlet 170 and the plug 171 in this manner, it is possible to insert the plug 171 into the outlet 170 safely and to remove 170 from the outlet.

The preferred embodiments of the present invention have been described above with reference to the accompanying drawings, whilst the present invention is not limited to the above examples, of course. A person skilled in the art may find various alternations and modifications within the scope of the appended claims, and it should be understood that they will naturally come under the technical scope of the present invention.

REFERENCE SIGNS LIST

1 electric power supplying system
10 bus line
100 power supply server
110 AC/DC converter
120 server controller
130 modem
140 inductor
150 switch
160 commercial power source
170 outlet
171 plug
181 electrode
182 cover
183*a*, 183*b* lock release mechanism
184 inclined portion
191 housing
192 electrode
193 protruding portion
194 electrode protection cover
195*a*, 195*b* lock mechanism
196*a*, 196*b* recessed portion
197 cutaway portion
198 electrode hole
200 client
210 DC/DC converter
220 client controller
230 modem
240 inductor
250, 260 switch
270 battery
280 load
290 outlet
291 plug

The invention claimed is:

1. A plug comprising:

at least two electrodes;

a housing that supports the electrodes, wherein the housing includes a reverse insertion inhibition portion comprising a cutaway portion of the housing that inhibits connection with a different polarity;

an electrode cover that covers the electrodes when the plug is not inserted into a plug receptacle and that withdraws into the housing and exposes the electrodes when the plug is inserted into the plug receptacle;

and a lock mechanism which inhibits the electrode cover from withdrawing into the housing when not inserted into the plug receptacle, and which allows the electrode cover to withdraw into the housing when inserted into the plug receptacle.

2. The plug according to claim 1, wherein the lock mechanism is depressed by the plug receptacle when connected with the plug receptacle and allows the electrode cover to withdraw into the housing.

3. A plug receptacle comprising:

a cover that protects electrodes; and a lock release mechanism, the plug receptacle configured to accommodate a plug comprising:

at least two electrodes, a housing that supports the electrodes, wherein the housing includes a reverse insertion inhibition portion comprising a cutaway portion of the housing that inhibits connection with a different polarity, an electrode cover that covers the electrodes when the plug is not inserted into a plug receptacle and that withdraws into the housing and exposes the electrodes when inserted into the plug receptacle, and a lock mechanism which inhibits the electrode cover from withdrawing into the housing when not inserted into the plug receptacle, and which allows the electrode cover to withdraw into the housing when inserted into the plug receptacle, wherein the lock release mechanism releases the lock mechanism when the plug is inserted into the plug receptacle.

4. The plug receptacle according to claim 3, wherein the lock release mechanism depresses the lock mechanism and thereby enables the electrode cover to withdraw into the housing.

5. The plug receptacle according to claim 3, wherein the cover includes a reverse insertion inhibition portion that inhibits connection of the plug with a different polarity.

6. An electric power supplying system comprising:

a bus line which is formed by at least two conductors and on which an information signal representing information is superimposed on electric power;

at least one power supply server which is connected to the bus line and which supplies the electric power;

and at least one client which is connected to the bus line and which receives the supply of the electric power from the power supply server, wherein at least one of the power supply server and the client is provided with a plug that comprises:

at least two electrodes, a housing that supports the electrodes, wherein the housing includes a reverse insertion inhibition portion comprising a cutaway portion of the housing that inhibits connection with a different polarity, an electrode cover that covers the electrodes when the plug is not inserted into a plug receptacle and that withdraws into the housing and exposes the electrodes when inserted into the plug receptacle, and a lock mechanism which inhibits the electrode cover from withdrawing into the housing when not inserted into the plug receptacle, and which allows the electrode cover to withdraw into the housing when inserted into the plug receptacle, and wherein the bus line is provided with the plug receptacle that comprises:

a cover that protects electrodes, and a lock release mechanism that, when the plug is inserted into the plug receptacle, releases the lock mechanism, enabling the electrode cover to withdraw into the housing.

* * * * *